US008091541B2

(12) United States Patent
Andresen

(10) Patent No.: US 8,091,541 B2
(45) **Date of Patent: *Jan. 10, 2012**

(54) DEVICE FOR FEEDING BALLS INTO THE BALL CHAMBER OF A HANDGUN

(75) Inventor: Heddies Andresen, Quickborn (DE)

(73) Assignee: Kee Action Sports I LLC, Sewell, NJ (US)

( * ) Notice: Subject to any disclaimer, the term of this patent is extended or adjusted under 35 U.S.C. 154(b) by 149 days.

This patent is subject to a terminal disclaimer.

(21) Appl. No.: 11/768,644

(22) Filed: Jun. 26, 2007

(65) Prior Publication Data

US 2007/0246479 A1 Oct. 25, 2007

Related U.S. Application Data

(63) Continuation of application No. 11/182,263, filed on Jul. 15, 2005, now Pat. No. 7,234,456, which is a continuation-in-part of application No. 10/965,384, filed on Oct. 14, 2004, now Pat. No. 7,428,899.

(51) Int. Cl.
*F41B 11/02* (2006.01)

(52) U.S. Cl. ..... 124/51.1; 124/48

(58) Field of Classification Search ..... 124/48, 124/51.1, 52, 53

See application file for complete search history.

(56) References Cited

U.S. PATENT DOCUMENTS

| | | | |
|---|---|---|---|
| 1,403,689 | A | 1/1922 | Hyndman |
| 1,404,689 | A | 1/1922 | Fairweather |
| 1,743,576 | A | 1/1930 | Smith |
| 1,867,513 | A | 7/1932 | Lahti |
| 2,357,951 | A | 9/1944 | Hale |
| 2,398,263 | A | 4/1946 | Trimbach |
| 3,248,008 | A | 4/1966 | Meierjohan |

(Continued)

FOREIGN PATENT DOCUMENTS

| | | |
|---|---|---|
| DE | 876370 | 5/1953 |

(Continued)

OTHER PUBLICATIONS

WARPIG—World and Regional Paintball Information Guide, http://www.warpig.com/paintball/technical/loaders/halo/index.shtml, WARPIG.com, Odyssey Readies Halo For Production, By Bill Mills, Jun. 2001, pp. 1 to 5.

(Continued)

*Primary Examiner* — John Ricci
(74) *Attorney, Agent, or Firm* — Volpe and Koenig, P.C.

(57) ABSTRACT

The invention relates to a device for feeding projectile balls into the ball chamber of a handgun, especially into the ball chamber of a paintball gun, having a ball container with an outlet port, a feeder tube between the outlet port and the ball chamber, and an essentially cylindrical feeder with an axis for feeding the balls from the ball container to the feeder tube. The device comprises a flexible element that is disposed inside the ball container adjacent to the outlet port. A first end of the flexible element is fixed to the ball container and the flexible element is essentially rigid in the direction of the axis. Balls that are not in the correct position when approaching the outlet port are deflected back into the ball container, instead of hitting the edge of the outlet port. This way, jamming of the balls and explosion by excessive pressure are prevented.

15 Claims, 2 Drawing Sheets

U.S. PATENT DOCUMENTS

| | | | |
|---|---|---|---|
| 3,467,073 | A | 9/1969 | Rhodes |
| 3,610,223 | A | 10/1971 | Green |
| 3,695,246 | A | 10/1972 | Filippi et al. |
| 3,788,298 | A | 1/1974 | Hale |
| 3,844,267 | A | 10/1974 | Mohr |
| 3,867,921 | A | 2/1975 | Politzer |
| 3,990,426 | A | 11/1976 | Stokes |
| 4,112,911 | A | 9/1978 | Petrick, Sr. |
| 4,185,824 | A | 1/1980 | Natwick |
| 4,207,857 | A | 6/1980 | Balka, Jr. |
| 4,332,097 | A | 6/1982 | Taylor, Jr. |
| 4,563,999 | A | 1/1986 | Miehlich |
| 4,745,842 | A | 5/1988 | Shou-Fu |
| 4,759,435 | A | 7/1988 | Cedrone |
| 4,819,609 | A | 4/1989 | Tippmann |
| 4,926,742 | A | 5/1990 | Ma et al. |
| 4,951,548 | A | 8/1990 | Wixon et al. |
| 4,965,951 | A | 10/1990 | Miller et al. |
| 4,986,251 | A | 1/1991 | Lilley |
| 4,993,400 | A | 2/1991 | Fitzwater |
| 5,063,905 | A | 11/1991 | Farrell |
| 5,097,516 | A | 3/1992 | Amir |
| 5,166,457 | A | 11/1992 | Lorenzetti |
| 5,282,454 | A | 2/1994 | Bell et al. |
| 5,335,579 | A | 8/1994 | David |
| 5,383,442 | A | 1/1995 | Tippmann |
| 5,456,153 | A | 10/1995 | Bentley et al. |
| 5,490,493 | A | 2/1996 | Salansky |
| 5,505,188 | A | 4/1996 | Williams |
| 5,511,333 | A | 4/1996 | Farrell |
| 5,520,171 | A | 5/1996 | David |
| 5,561,258 | A | 10/1996 | Bentley et al. |
| 5,600,083 | A | 2/1997 | Bentley et al. |
| 5,722,383 | A | 3/1998 | Tippmann, Sr. et al. |
| 5,736,720 | A | 4/1998 | Bell et al. |
| 5,771,875 | A | 6/1998 | Sullivan |
| 5,791,325 | A | 8/1998 | Anderson |
| 5,794,606 | A | 8/1998 | Deak |
| 5,809,983 | A | 9/1998 | Stoneking |
| 5,816,232 | A | 10/1998 | Bell |
| 5,839,422 | A | 11/1998 | Ferris |
| 5,881,962 | A | 3/1999 | Schmidt et al. |
| 5,947,100 | A | 9/1999 | Anderson |
| 5,954,042 | A | 9/1999 | Harvey |
| 6,032,395 | A | 3/2000 | Bentley et al. |
| 6,055,975 | A | 5/2000 | Gallagher et al. |
| 6,109,252 | A | 8/2000 | Stevens |
| 6,213,110 | B1 | 4/2001 | Christopher et al. |
| 6,220,237 | B1 | 4/2001 | Johnson et al. |
| 6,305,367 | B1 | 10/2001 | Kotsiopoulos et al. |
| 6,327,953 | B1 * | 12/2001 | Andresen ..... 89/33.17 |
| 6,347,621 | B1 | 2/2002 | Guthrie |
| 6,374,819 | B1 | 4/2002 | Ming-Hsien |
| 6,408,837 | B1 | 6/2002 | Johnson et al. |
| 6,415,781 | B1 | 7/2002 | Perrone |
| 6,418,919 | B1 | 7/2002 | Perrone |
| 6,467,473 | B1 | 10/2002 | Kostiopoulos |
| 6,481,432 | B2 | 11/2002 | Rushton et al. |
| 6,488,019 | B2 | 12/2002 | Kotsiopoulos |
| 6,502,567 | B1 | 1/2003 | Christopher et al. |
| 6,591,824 | B2 | 7/2003 | Hatcher |
| 6,644,293 | B2 | 11/2003 | Jong |
| 6,701,907 | B2 | 3/2004 | Christopher et al. |
| 6,729,497 | B2 | 5/2004 | Rice et al. |
| 6,739,322 | B2 | 5/2004 | Rice et al. |
| 6,739,323 | B2 | 5/2004 | Tippmann, Jr. |
| 6,792,933 | B2 | 9/2004 | Christopher et al. |
| 6,889,680 | B2 | 5/2005 | Christopher et al. |
| 6,981,493 | B1 | 1/2006 | Poteracke |
| 7,021,302 | B2 | 4/2006 | Neumaster |
| 7,222,617 | B2 | 5/2007 | Andresen |
| 7,234,456 | B2 * | 6/2007 | Andresen ..... 124/51.1 |
| 7,270,121 | B2 | 9/2007 | Lubben |
| 7,357,129 | B2 | 4/2008 | Neumaster et al. |
| 7,428,899 | B2 | 9/2008 | Andresen |
| 7,770,569 | B2 | 8/2010 | Andresen |
| 7,841,328 | B2 | 11/2010 | Italia et al. |
| 2004/0074487 | A1 | 4/2004 | Christopher et al. |
| 2005/0188978 | A1 | 9/2005 | Tiberius et al. |
| 2007/0017494 | A1 | 1/2007 | Andresen |
| 2007/0017495 | A1 | 1/2007 | Andresen |
| 2007/0215137 | A1 | 9/2007 | Jones et al. |
| 2007/0246479 | A1 | 10/2007 | Andresen |
| 2008/0047536 | A1 | 2/2008 | Chen |
| 2008/0047537 | A1 | 2/2008 | Kulp et al. |
| 2008/0178859 | A1 | 7/2008 | Moore et al. |
| 2009/0000608 | A1 | 1/2009 | Christopher et al. |
| 2009/0025700 | A1 | 1/2009 | Andresen |
| 2009/0133680 | A1 | 5/2009 | Christopher et al. |

FOREIGN PATENT DOCUMENTS

| | | | |
|---|---|---|---|
| DE | 2035097 | | 8/1982 |
| DE | 3721527 | C2 | 1/1989 |
| DE | 4343870 | A1 | 6/1994 |
| DE | 19922589 | | 12/2000 |
| EP | 0075970 | | 4/1983 |
| EP | 01054228 | | 11/2000 |
| EP | 01653189 | | 5/2006 |
| FR | 921527 | | 5/1947 |
| GB | 470201 | | 8/1937 |
| GB | 551077 | | 2/1943 |
| GB | 2322438 | A | 8/1998 |
| JP | 1179898 | | 7/1989 |
| JP | 6325233 | | 11/1994 |
| TW | M255391 | Y | 1/2005 |
| WO | 9813660 | | 4/1998 |
| WO | 0144745 | A1 | 6/2001 |
| WO | 02/42708 | | 5/2002 |
| WO | 03087698 | | 10/2003 |
| WO | 2007/035601 | | 3/2007 |
| WO | 2007033309 | | 3/2007 |
| WO | 2007044546 | | 4/2007 |
| WO | 2007044822 | | 4/2007 |
| WO | 2007/098554 | A1 | 9/2007 |
| WO | 2008104061 | | 4/2008 |
| WO | 2009/009748 | A1 | 1/2009 |

OTHER PUBLICATIONS

WARPIG—World and Regional Paintball Information Guide, http://www.warpig.com/paintball/technical/loaders/halo/review.shtml, WARPIG.com, Odyssey Halo By Bill Mills, Dec. 2001, pp. 1 to 7.

Odyssey Halo B Paintball Hopper Review, http://www.paintball-gun-review.com/hopper-reviews/odyssey-halo-b . . . , Paintball Gun Review, Odyssey Halo B Paintball Hopper Review, 2004 Paintball-Gun-Review.com, pp. 1 to 4.

www.OdysseyPaintball.com, http://web.archive/org/web/20030205112543/http://www.odysseypain . . . , Odyssey Paintball Products, Understanding Halo B, pp. 1 to 3.

WARPIG—World And Regional Paintball Information Guide, http://www.warpig.com/paintball/technical/loaders/evlution/evlution . . . eVLution 2 Sneak Preview, by Bill Mills, Aug. 2001, p. 1 to 4.

WARPIG—World And Regional Paintball Information Guide, http://www.warpig.com/paintball/technical/loaders/evlution/index.shtml Brass Eagle's eVLution Loader, by Bill Mills, Aug. 2000, pp. 1 to 7.

WARPIG—World And Regional Paintball Information Guide, http://www.warpig.com/paintball/technical/labs/revytimes/index/shtml WARPIG Ballistic Labs Report: Revolution Response Times, by Bill Mills, copyright 1992-2010, pp. 1 to 4.

* cited by examiner

DEVICE FOR FEEDING BALLS INTO THE BALL CHAMBER OF A HANDGUN

CROSS REFERENCE TO RELATED APPLICATION(S)

This application is a continuation U.S. patent application Ser. No. 11/182,263, filed Jul. 15, 2005, which claims the benefit of U.S. patent application Ser. No. 10/965,384, filed on Oct. 14, 2004, which are incorporated by reference as if fully set forth.

BACKGROUND

The invention relates to a device for feeding projectile balls into the ball chamber of a handgun, especially to the ball chamber of a paintball gun. The device comprises a ball container with an outlet port, a feeder tube, that extends between the outlet port and the ball chamber, and an essentially cylindrical feeder with an axis for feeding the balls from the ball container to the feeder tube.

A device of that kind is known from U.S. Ser. No. 10/965,384 filed on Oct. 14, 2004, whose disclosure is herewith incorporated by reference in the disclosure of the present application and whose characteristics are part of the disclosure of the present application. The feeder of the device exerts a feeding force to the ball. By means of this feeding force the balls are fed from the ball container through the outlet port into the feeder tube. If the balls are not in the correct position when approaching the outlet port, they hit the edge of the outlet port instead of entering it. There is a risk that balls hitting the edge will jam or explode under the feeding force. The storage device is then no longer operational.

It is an object of the invention to reduce operational impairment from exploded or jammed balls.

SUMMARY

According to one embodiment of the invention, a flexible element is disposed inside the ball container adjacent to the outlet port, a first end of the flexible element is fixed to the ball container and the flexible element is essentially rigid in the direction of the axis. A ball, which is not in the correct position when approaching the outlet port, contacts the flexible element before hitting the edge of the outlet port. The flexible element bends under the feeding force and deflects the ball back into the ball container. The flexible element is essentially rigid in the direction of the axis of the feeder to prevent the flexible element bending under the load of the balls in the container as in previously known devices. Bending under the load of the balls in the container impairs the ability to deflect the incorrectly positioned balls back into the container. The direction of the axis is a direction, which is perpendicular to the direction of the movement of the balls, when moving towards the outlet port.

A second end of the flexible element can in a preferred embodiment be slideably engaged to a protrusion in the wall of the ball container. The protrusion keeps the flexible element at a distance from the outlet port. This distance allows the flexible element to bend in a suitable manner.

The flexible element may be of sheet- or bladelike shape. This shape best suits the aim to guide the balls along the shape of the flexible element back into the container. The shape of the flexible element can be further improved, in that it is elongated between the first and the second end and in that the distance between the first and second ends exceeds the diameter of the outlet port.

In a preferred embodiment the flexible element is made from an elastic plastics material. Suitable materials may be, for example, polyoxymethylene (POM), polyethylene (PE), acrylohitrile-butadiene-styrene (ABS) or polycarbonate.

In one embodiment of the invention the ball container can be a separate part, which is carried at a distance from the handgun. In this case the feeder tube is preferably made of a flexible material, so that the maneuverability of the handgun is not impaired. Alternatively the ball container can be fixed to the handgun.

BRIEF DESCRIPTION OF THE DRAWINGS

An exemplary embodiment of the invention is described below with reference to the figures, wherein.

DETAILED DESCRIPTION OF THE PREFERRED EMBODIMENTS

Figure 1:
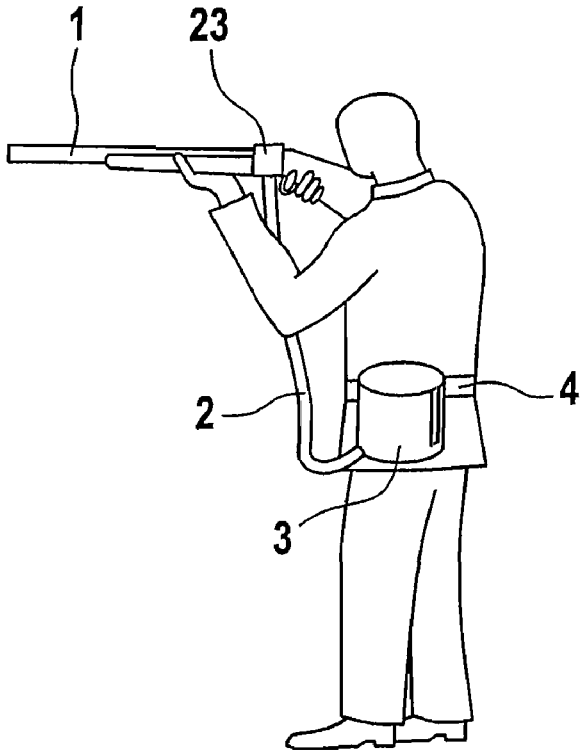
FIG. 1 shows the device according to the invention when being in use.

According to FIG. 1, a shooter uses an arm 1, for example an air gun for so-called paintballs, which is connected with a ball container 3 containing balls, through a flexible feeder tube 2. The balls are fed in a continuous process through a feeder 8 to the ball chamber 23 of the gun 1. In an alternative embodiment according to FIG. 2, the feeder tube 2 is rigid and the ball container 3 is in a fixed position relative to the arm 1.

Figure 3:
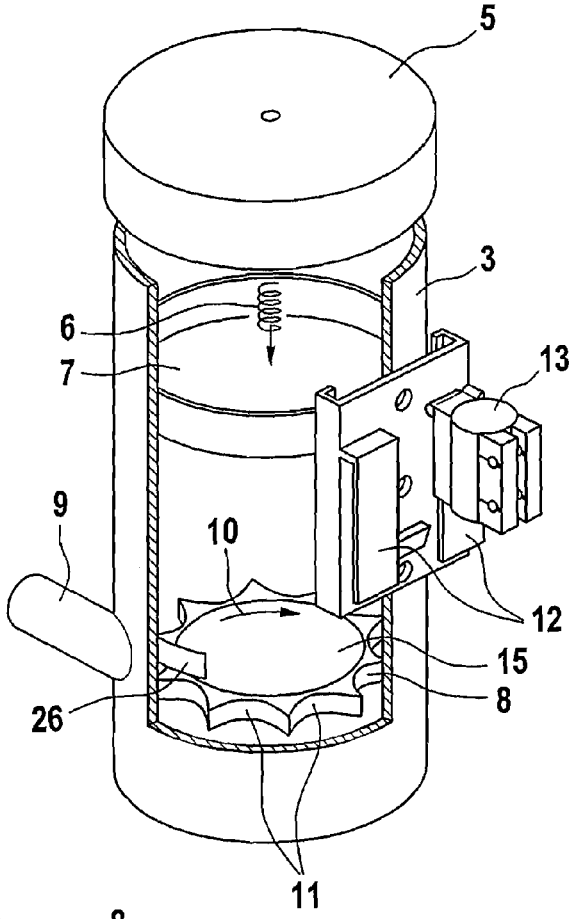
FIG. 3 shows the partially sectioned ball container and feeder.
Figure 4:
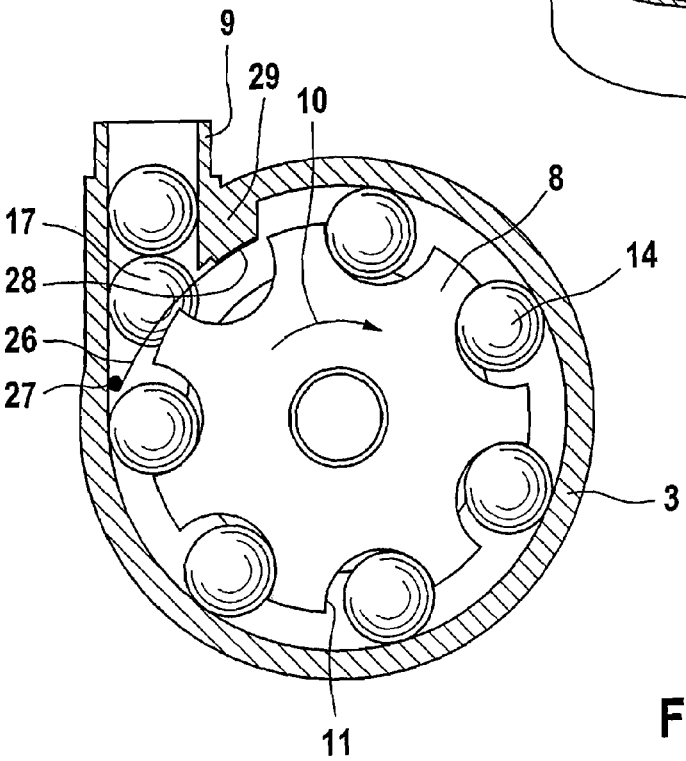
FIG. 4 shows a transversal section through the ball container, looking towards the feeder.

According to FIG. 3, the ball container 3 is of a cylindrical shape and provided with a cover lid 5 connected with a pressure plate 7 via a schematically indicated tension spring 6. The pressure plate 7, under the impact from the spring 6, pushes the contents of the container away from the open end of the container shut by the lid, to its other end. At this other end is the feeder 8 that feeds the balls through an outlet port 17 into the discharge canal 9 of the ball container 3 which is connected to the input end of the feeder tube 2. The feeder 8 is driven by an electric motor via a slip clutch and a spring element (all not shown), which are described in detail in U.S. application Ser. No. 10/965,384 filed on Oct. 14, 2004. The motor is supplied with power from a battery (also, not shown) that is arranged in a suitable place. The container can be hooked onto the belt 4 of the shooter by means of hooks 12. In addition, a connector device 13 can be provided for the optional attachment of the container 3 to the arm 1. Alternatively the container can be carried in a rucksack-like manner.

The pressure plate 7 ensures that the balls contained in the container can be fed into the feeder in any position of the container 3.

Figure 2:
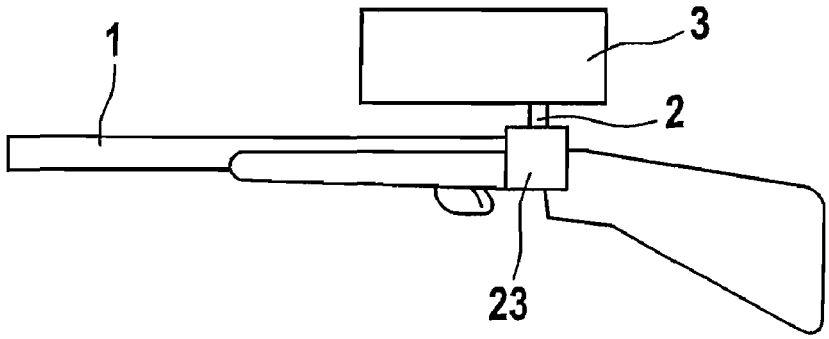
FIG. 2 shows another embodiment of the device according to the invention.

According to FIGS. 2 and 3, the feeder 8 is in the shape of a disk that is concentrically arranged in the cylindrical ball container 3. By rotating the feeder 8 in the direction of the arrow 10, the balls 14 in the feeder chambers 11 located at the periphery of the feeder 8 are fed through the outlet port 17 into the discharge canal 9 of the ball container 3. The balls 14 in the ball container 3 are pressed by the pressure plate 7 against the upper side of the feeder 8. The feeder 8 has a conical surface 15, so that the balls, under pressure from the pressure plate 7, are deviated outward to the feeding chambers 11. This ensures that the feeding chamber 11 from which, a ball was fed into the discharge canal is immediately filled with a new ball. The rear part of the feeding chamber 11 which pushes the ball in the direction of the discharge canal 9, is preferably shaped in such a way that the ball is pushed simultaneously outward toward the wall of the ball container 3 and downward toward the bottom of the ball container, so that the ball moves along a defined path in the direction of the discharge canal 9.

Above the discharge canal 9 a flexible element 26 is disposed. A first end 27 of the flexible element 26 is fixed to the wall of the ball container 3. A second end 28 of the flexible element 26 bears slideably on a protrusion 29, that projects from the wall of the ball container 3. A lower end of the flexible element 26 is located at the same height as the upper end of the outlet port 17. The flexible element 26 has an elongate, sheetlike shape and extends along the edge of the outlet port 17.

A ball, which is not in the correct position within the feeding chamber 11 and projects over the upper end of the feeding chamber 11, touches the flexible element 26, before it is pushed against the edge of the feeder tube. The flexible element 26 bends under the feeding force, thereby sliding with its second 28 end along the surface of the protrusion 29. Driven by the rotation of the feeder 8 and the tension of the flexible element 26, the ball is deflected back into the ball container 3.

What is claimed is:

1. A device for feeding projectile balls into the ball chamber of a handgun especially to the ball chamber of a paintball gun, the device comprising:

a ball container adapted to be worn by a user, the ball container comprising an outlet port;

a feeder tube between the outlet port and the ball chamber;

an essentially cylindrical feeder with an axis for feeding the balls from the ball container to the feeder tube; and a flexible element disposed inside the ball container adjacent to the outlet port, wherein a first end of the flexible element is fixed to the ball container, a second end of the flexible element slideably bears on the wall of the ball container, and the flexible element is essentially rigid in the direction of the axis.

2. The device of claim 1, wherein the second end of the flexible element slideably bears on a protrusion which projects from the wall of the ball container.

3. The device of claim 2, wherein the flexible element is of sheet or bladelike shape.

4. The device of claim 3, wherein the flexible element has an elongate shape and the distance between the first and second ends exceeds the diameter of the outlet port.

5. The device of claim 4, wherein the flexible element is made from an elastic plastic material.

6. The device of claim 5, wherein the ball container is arranged in a fixed position relative to the handgun.

7. The device of claim 5, wherein the ball container and the handgun are separated from each other and the feeder tube is made of a flexible material.

8. The device of claim 4, wherein the ball container is arranged in a fixed position relative to the handgun.

9. The device of claim 4, wherein the ball container and the handgun are separated from each other and the feeder tube is made of a flexible material.

10. The device of claim 3, wherein the ball container is arranged in a fixed position relative to the handgun.

11. The device of claim 3, wherein the ball container and the handgun are separated from each other and the feeder tube is made of a flexible material.

12. The device of claim 2, wherein the ball container is arranged in a fixed position relative to the handgun.

13. The device of claim 2, wherein the ball container and the handgun are separated from each other and the feeder tube is made of a flexible material.

14. The device of claim 1, wherein the ball container is arranged in a fixed position relative to the handgun.

15. The device of claim 1, wherein the ball container and the handgun are separated from each other and the feeder tube is made of a flexible material.

* * * * *